US006553192B2

(12) United States Patent
Maebashi

(10) Patent No.: US 6,553,192 B2
(45) Date of Patent: Apr. 22, 2003

(54) IMAGE FORMING APPARATUS HAVING PLURAL IMAGE TRANSFER OPERATION MODES INCLUDING DIFFERENT TRANSFER CHARGING FEATURES

(75) Inventor: Yoichiro Maebashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/799,059

(22) Filed: Mar. 6, 2001

(65) Prior Publication Data

US 2001/0043817 A1 Nov. 22, 2001

(30) Foreign Application Priority Data

Mar. 8, 2000 (JP) ..... 2000-064082
Feb. 13, 2001 (JP) ..... 2001-036076

(51) Int. Cl.[7] ..... G03G 15/02
(52) U.S. Cl. ..... 399/50
(58) Field of Search ..... 399/38, 39, 50, 399/55, 174, 298, 299, 302, 306, 308

(56) References Cited

U.S. PATENT DOCUMENTS 4,935,787 A * 6/1990 Maeda et al. ..... 399/39
5,426,487 A * 6/1995 Stelter et al. ..... 399/171
5,596,393 A * 1/1997 Kobayashi et al. ..... 399/174
5,991,557 A * 11/1999 Kunishi et al. ..... 399/50 X
6,324,374 B1 * 11/2001 Sasamoto et al. ..... 399/298

FOREIGN PATENT DOCUMENTS

JP 362220977 * 9/1987

* cited by examiner

*Primary Examiner*—Hoan Tran
(74) *Attorney, Agent, or Firm*—Fitzpatrick, Cella, Harper & Scinto

(57) ABSTRACT

The voltage value or frequency of an AC voltage component applied to charging rollers in a mono-colored black image forming mode is reduced so as to be smaller than the value or frequency applied in the full-colored image forming mode. In this manner, in the mono-colored black image forming mode, electric discharge between the charging rollers and photosensitive drums which does not form images is reduced, so that a shaving-off phenomenon on the surfaces of the photosensitive drums can be decrease, thereby increasing a lifespan of the photosensitive drums.

20 Claims, 7 Drawing Sheets

IMAGE FORMING APPARATUS HAVING PLURAL IMAGE TRANSFER OPERATION MODES INCLUDING DIFFERENT TRANSFER CHARGING FEATURES

BACKGROUND OF THE INVENTION

1. Field of the Invention

The present invention relates to an image forming apparatus employing an electrophotographic system therein, and in particular relates to an image forming apparatus for use in copying machines and facsimile machines, etc., for example.

2. Description of the Related Art

Recently, a so-called tandem-type image forming apparatus has been proposed as a multicolored or full-colored electrophotographic apparatus, in which plural photosensitive drums are arranged in a line. Each drum corresponds to a different color, and a toner image formed on each drum is sequentially overlaid on a recording member to form a color image thereon.

FIG. 7 is a schematic block diagram showing an example of a conventional full-colored tandem-type image forming apparatus employing an electrophotographic system therein.

The image forming apparatus comprises four image forming sections (image forming units) which are an image forming section 101M for forming a magenta image, an image forming section 101C for forming a cyan image, an image forming section 101Y for forming a yellow image, and an image forming section 101Bk for forming a black image. These four image forming sections are arranged in a line and spaced at predetermined intervals.

These image forming sections 101M, 101C, 101Y, and 101Bk are provided with photosensitive drums 102*a*, 102*b*, 102*c*, and 102*d*, respectively. Around the photosensitive drums 102*a*, 102*b*, 102*c*, and 102*d*, charging rollers 103*a*, 103*b*, 103*c*, and 103*d*, developing devices 104*a*, 104*b*, 104*c*, and 104*d*, transfer rollers 105*a*, 150*b*, 105*c*, and 105*d*, and drum cleaning devices 106*a*, 106*b*, 106*c*, and 106*d* are arranged, respectively. In upper portions between the charging rollers 103*a*, 103*b*, 103, and 103*d* and the developing devices 104*a*, 104*b*, 104*c*, and 104, exposure devices 107*a*, 107*b*, 107*c*, and 107*d* are arranged, respectively. In the developing devices 104*a*, 104*b*, 104*c*, and 104*d*, magenta toner, cyan toner, yellow toner, and black toner are stored, respectively.

In order to form an image on a recording member, each toner image formed on each photosensitive drum is transferred to the recording member which is carried on and conveyed by a conveying belt, thereby sequentially overlaying each toner image thereon. Then, using a fuser, the toner image is fixed on the recording member and the recording member is separated from the conveying belt and discharged from the apparatus.

By the way, when using the above-mentioned color image forming apparatus, not only full-colored printing, but also mono-colored (black) printing is frequently performed, and the rate of the latter case tends to increase recently.

However, in the above-mentioned conventional color image forming apparatus, even during the mono-colored (black) image forming, the four image forming sections (image forming units) 101M, 101C, 101Y, and 101BK are activated. Accordingly, the surfaces of the photosensitive drums 102*a*, 102*b*, and 102*c* of the image forming sections 101M, 101C, and 101Y which do not form images are mechanically ground just like during the full-colored printing due to the friction of the charging rollers 103*a*, 103*b*, and 103*c*, the developing devices 104*a*, 104*b*, and 104*c*, the drum cleaning devices 106*a*, 106*b*, and 106*c*, and a recording member P. That is, during the mono-colored printing, the losses of the surfaces of the photosensitive drums 102*a*, 102*b*, and 102*c* of the image forming sections 101M, 101C, and 101Y which do not form images are also caused by abrasion.

Also, in order to equalize the charge on the entire surface of the photosensitive drum when charging it by using the charging roller, in the voltage applied to the charging roller, a DC voltage is superposed on an AC voltage. In such a structure, due to the AC voltage, the surfaces of the photosensitive drums 102*a*, 102*b*, and 102*c*, which do not form images may be degraded, thereby reducing an endurance life thereof. This is mainly because the degradation of the photosensitive drum is caused by the electric discharge that occurs between the charging roller and the photosensitive drum due to the AC voltage.

Moreover, in recent color image forming apparatuses, a process cartridge may be used for improving usability, in which the charging device, the developing device, a toner container, etc., are integrated into the photosensitive drum. When mono-colored (black) printing is frequently performed in such an image forming apparatus, the degradation of the photosensitive drum may be advanced even when color toner is not consumed in the process cartridge. Thus, the life of the photosensitive drum can end before the color toner is fully consumed, thereby causing the remaining toner to be undersirably abandoned.

SUMMARY OF THE INVENTION

Accordingly, it is an object of the present invention to provide an image forming apparatus capable of increasing the life of an image carrier.

Further objects, features and advantages of the present invention will become apparent from the following description of the preferred embodiments with reference to the attached drawings.

DESCRIPTION OF THE PREFERRED EMBODIMENTS

Embodiments according to the present invention will be described below with reference to the drawings.

First Embodiment

Figure 1:
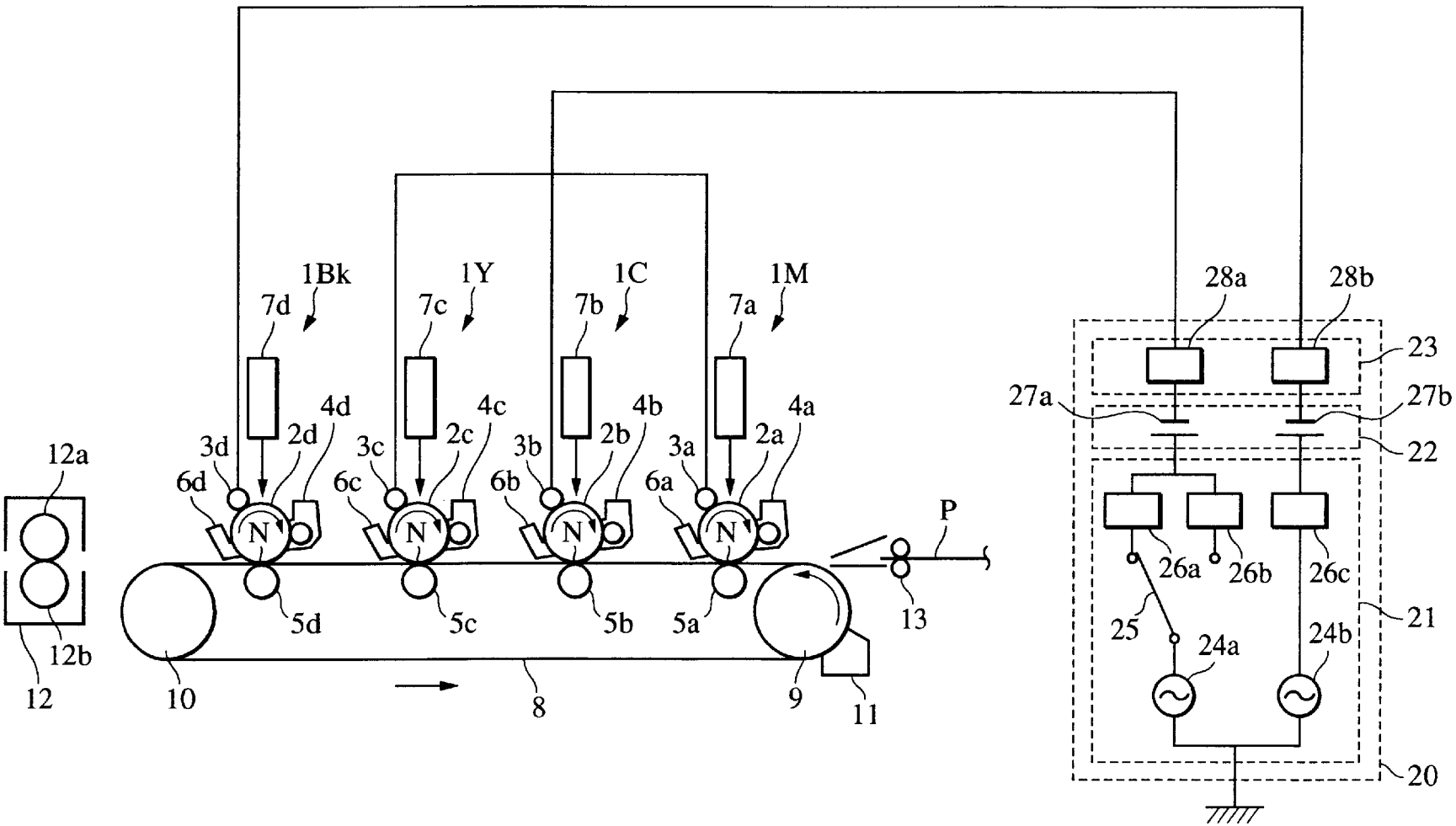
FIG. 1 is a schematic block diagram of an image forming apparatus according to a first embodiment of the present invention.

FIG. 1 is a schematic block diagram of an image forming apparatus according to a first embodiment of the present invention (a tandem-type full-colored image forming apparatus employing an electrophotographic system therein in this embodiment).

The image forming apparatus comprises four image forming sections (image forming units) which are an image forming section 1M for forming a magenta image, an image forming section 1C for forming a cyan image, an image forming section 1Y for forming a yellow image, and an image forming section 1BK for forming a black image, and these four image forming sections are arranged in a line and spaced at predetermined intervals.

These image forming sections 1M, 1C, 1Y, and 1BK are provided with photosensitive drums 2*a*, 2*b*, 2*c*, and 2*d* as image carriers, respectively. Around the photosensitive drums 2*a*, 2*b*, 2*c*, and 2*d*, charging rollers 3*a*, 3*b*, 3*c*, and 3*d* as charging means, developing devices 4*a*, 4*b*, 4*c*, and 4*d*, transfer rollers 5*a*, 5*b*, 5*c*, and 5*d*, and drum cleaning devices 6*a*, ,6*b*, 6*c*, and 6*d* are arranged, respectively. In upper portions between the charging rollers 3*a*, 3*b*, 3*c*, and 3*d* and the developing devices 4*a*, 4*b*, 4*c*, and 4*d*, exposure devices 7*a*, 7*b*, 7*c*, and 7*d* are arranged, respectively. The developing devices 4*a*, 4*b*, 4*c*, and 4*d* are respectively provided with magenta toner, cyan toner, yellow toner, and black toner stored therein and having negatively charged characteristics.

In the embodiment, the photosensitive drums 2*a*, 2*b*, 2*c*, and 2*d* have photosensitive layers which are negatively charged organic photosensitive materials and formed on a drum body made from aluminum, etc., and are rotated by a driving device in an arrow direction (clockwise) at a predetermined process speed.

The charging rollers 3*a*, 3*b*, 3*c*, and 3*d* make contact with the photosensitive drums 2*a*, 2*b*, 2*c*, and 2*d*, respectively, at a predetermined contact force so as to uniformly charge the surface of each of the photosensitive drums 2*a*, 2*b*, 2*c*, and 2*d* at a predetermined potential by a charging bias applied from a charging bias power supply. In addition, in the embodiment, each photosensitive drum is charged to have negative polarity by each charging roller.

The developing devices 4*a*, 4*b*, 4*c*, and 4*d* comprise developing sleeves as members for bearing developer. The thin toner films carried on the developing sleeves are transferred to portions opposing the photosensitive drums 2*a*, 2*b*, 2*c*, and 2*d* (developing portions) by the rotation of the developing sleeves, so that an electrostatic latent image formed on the photosensitive drum is developed as a toner image (reversal development) by the developing bias applied to the developing sleeve. In addition, the distance between the photosensitive drum and the developing sleeve in the developing portion is held constant even in a monocolored image forming mode or in a full-colored image forming mode, which will be described later (identical with a two-colored mode and a three-colored mode).

The transfer rollers 5*a*, 5*b*, 5*c*, and 5*d* formed from an elastic member abut the respective photosensitive drums 2*a*, 2*b*, 2*c*, and 2*d* at each transfer portion N via an endless conveyor belt 8 for a recording member. To the transfer rollers 5*a*, 5*b*, 5*c*, and 5*d*, a transfer power supply (not shown) is connected.

In the exposure devices (laser scanner devices) 7*a*, 7*b*, 7*c*, and 7*d*, a laser beam modulated in response to each electric digital pixel signal in a time series of image information inputted from a host computer (not shown) is outputted from a laser output unit (not shown) so as to expose the surface of each of the photosensitive drums 2*a*, 2*b*, 2*c*, and 2*d* with an image via each reflecting mirror (not shown), so that an electrostatic latent image corresponding to the image information is formed on the surface of each of the photosensitive drums 2*a*, 2*b*, 2*c*, and 2*d* which are charged by the respective charging rollers 3*a*, 3*b*, 3*c*, and 3*d*.

The conveyor belt 8 for a recording member as a member bearing a recording member is stretched between a driving roller 9 and a supporting roller 10 and is rotated (moved) in an arrow direction (counterclockwise) by the driving of the driving roller 9. A sucking roller (not shown) for electrostatically sucking a recording member P as a copying medium on the conveyor belt 8 for a recording member is arranged in the upper stream side of the image forming section 1M on the conveyor belt 8. In the vicinity of the driving roller 9 outside the conveyor belt 8 for a recording member, a belt-cleaning device 11 is arranged. In the downstream side of the image forming section 1BK in the recording member conveying direction of the conveyor belt 8, a fuser 12 having a fixing roller 12*a* and a pressurizing roller 12*b* is provided.

Next, the image forming operation by the above-described image forming apparatus will be described.

When a signal for starting the image forming operation is outputted, each of the photosensitive drums 2*a*, 2*b*, 2*c*, and 2*d* rotating at a predetermined process speed in the image forming sections 1M, 1C, 1Y, and 1BK is uniformly charged by the respective charging rollers 3*a*, 3*b*, 3*c*, and 3*d* to have negative polarity in the embodiment. In the laser output unit (not shown), the exposure devices 7*a*, 7*b*, 7*c*, and 7*d* convert the respective color-separated image signals inputted from the host computer (not shown) into optical signals. Each of the charged photosensitive drums 2*a*, 2*b*, 2*c*, and 2*d* is scanned and exposed via the reflecting mirror (not shown) with the laser beam which is the converted optical signal so as to form an electrostatic latent image.

Then first, magenta toner is stuck on the electrostatic latent image formed on the photosensitive drum 2*a* by the developing device 4*a* having a developing bias applied thereto with the same polarity as charge polarity (negative polarity) of the photosensitive drum 2*a* so as to form a visible image as a toner image.

A recording member P conveyed in accordance with this timing by a sheet feeding roller 13 is electrostatically sucked by a sucking roller (not shown) having a sucking bias applied thereto on the surface of the conveyor belt 8 for a recording member which is moved by the driving of the driving roller 9; then, the recording member P is conveyed to the transfer portion N of the image forming section 1M, so that a magenta toner image is transferred on the recording member by the transfer roller 5*a* having a transfer bias applied thereto with the reverse polarity (positive polarity) to toner.

The recording member P having the magenta toner image transferred thereon is sucked on the surface of the conveyor belt 8 for a recording member so as to be conveyed toward the image forming section 1C. In the transfer portion N of the image forming section 1C, a cyan toner image formed on the photosensitive drum 2*b* is also transferred just as described above by the transfer roller 5*b* having a transfer bias applied thereto with the reverse polarity (positive polarity) to toner so as to be overlaid on the magenta toner image on the recording member P.

Similarly, on the magenta and cyan toner images transferred and overlaid on the recording member P, yellow and black toner images formed on the photosensitive drums 2*c* and 2*d* of the image forming sections 1Y and 1BK are sequentially overlaid in each transfer portion N by the transfer rollers 5*c* and 5*d* having transfer biases applied thereto with the reverse polarity (positive polarity) to toner so as to form a full-colored toner image on the recording member P.

Then, the recording member P having the full-colored image formed thereon is separated from the surface of the conveyor belt 8 for a recording member and is conveyed to the fuser 12, so that the full-colored toner image is heated and pressurized in the fixing nip between the fixing roller 12*a* and the pressurizing roller 12*b* of the fuser 12 so as to be thermally fixed on the surface of the recording member P, and then, discharged outside so as to finish a series of image forming operations.

During the transferring described above, transfer toner remnants remaining on the photosensitive drums 2*a*, 2*b*, 2*c*, and 2*d* are rubbed and removed by the drum cleaning devices 6*a*, 6*b*, 6*c*, and 6*d* so as to be recovered, respectively. The residual toner (toner images for detecting consistency, etc.) remaining on the surface of the conveyor belt 8 for a recording member after the transferring is removed by the belt-cleaning device 11 so as to be recovered.

In addition, a mono-colored mode for forming a black mono-colored image other than the full-colored mode described above can be selected. When the mono-colored mode is selected, only the image forming section for forming a black image is performed in a similar manner to the full-colored mode, and only a rotating mechanism for the photosensitive drums and a charging mechanism by the charging rollers in the other image forming sections are activated.

That is, even when the mono-colored mode is selected, in the image forming sections which do not form images, the photosensitive drums are rotated; their contact with the conveyor belt 8 for a recording member is maintained as well; furthermore, the rotation of the developing sleeves, the application of developing biases, and the rotation of the charging rollers and the application of charging biases for preventing a toner fog from the developing devices are performed. In the image forming sections which do not form images, the photosensitive drums are not exposed with light (or blank sheets are exposed with light) and the drum cleaning devices (cleaning blades) for cleaning photosensitive drums maintain the abutment to the photosensitive drums.

Next, the charging mechanism of each image forming section will be described in detail.

In the embodiment, to each of the charging rollers 3*a*, 3*b*, 3*c*, and 3*d* for charging the respective image forming sections (image forming units) 1M, 1C, 1Y, and 1BK, a high-voltage power supply 20 is connected as voltage applying means. When forming a mono-colored image (black), the high-voltage power supply 20 applies a voltage to each of the charging rollers 3*a*, 3*b*, 3*c*, and 3*d* different from the voltage applied when forming a full-colored image (the high-voltage power supply 20 will be described in detail later).

Each of the charging rollers 3*a*, 3*b*, 3*c*, and 3*d* for charging the respective photosensitive drums 2*a*, 2*b*, 2*c*, and 2*d* has a metallic core (not shown) at the center, on which a conductive elastic layer (not shown) is provided and on the surface of the elastic layer, an urethane rubber layer (not shown) having carbon particles dispersed therein is further formed. The urethane rubber layer is abutted on each surface of the photosensitive drums 2*a*, 2*b*, 2*c*, and 2*d* under a suitable pressure by urging both ends of the core thereto with urging members (not shown).

During the charging, a superposed voltage (alternative voltage) in which a DC voltage of −600V is superposed on an AC voltage having a frequency of 2000 Hz and a peak-to-peak voltage (referred to as a Vpp below) of 1800V is applied to the core from the charging bias power supply 20, so that the surfaces of the photosensitive drums 2*a*, 2*b*, 2*c*, and 2*d* are uniformly charged so as to have a potential of substantially −600V. In the embodiment, the waveform of the AC voltage is a sine wave; however, it is not limited to this and it may be a square wave or a triangular wave.

In addition, in order to converge the surface potential of each of the photosensitive drums 2*a*, 2*b*, 2*c*, and 2*d* to the same potential as the DC voltage value (−600V) applied to each of the charging rollers 3*a*, 3*b*, 3*c*, and 3*d*, it is preferable that a Vpp of the AC voltage ingredient be the double or more of a starting voltage. In the embodiment, the Vpp is to be approximately 1100V (the starting voltage is approximately 550V); however, density unevenness may be produced on a halftone image at this voltage (Vpp=1100V). This is because of very small unevenness, etc., in the surface resistance of the charging rollers 3*a*, 3*b*, 3*c*, and 3*d*, so that very small unevenness is produced in the charging potential of each of the photosensitive drums 2*a*, 2*b*, 2*c*, and 2*d*.

Therefore, it is preferable for obtaining a satisfactory image that a voltage which does not produce unevenness in charging each of the photosensitive drums 2*a*, 2*b*, 2*c*, and 2*d* be applied to each of the charging rollers, so that it is preferable that a Vpp of the AC voltage ingredient be 1800V or more. It is also preferable that a frequency of the AC voltage ingredient be a value preventing the production of a moire image (interference fringe pattern) produced by the interference between an image frequency and a charging frequency. The frequency in the embodiment is 2000 Hz. When the frequency is smaller than this value, a moire image may be produced.

Next, the structure of the high-voltage power supply 20 in the embodiment will be described.

The high-voltage power supply 20 is a circuit for generating a voltage to be applied to each of the charging rollers 3*a*, 3*b*, 3*c*, and 3*d*, and comprises an AC voltage generating unit 21, a DC voltage generating unit 22, and an amplifier circuit unit 23.

The AC voltage generating unit 21 comprises first and second AC voltage generating circuits 24*a* and 24*b* which are identical with each other, a change-over switch 25, and first, second, and third AC amplifier circuits 26*a*, 26*b*, and 26*c*. The first AC voltage generating circuit 24*a* is connected to the first AC amplifier circuit 26*a* or the second AC amplifier circuit 26*b* via the change-over switch 25; the second AC voltage generating circuit 24*b* is connected to the third AC amplifier circuit 26*c*. The first and second AC voltage generating circuits 24*a* and 24b generate sine wave AC voltages each having a frequency of 2000 Hz and a Vpp of 100V. The first and third AC amplifier circuits 26*a* and 26*c* amplify the respective inputted voltage values 18 times; the second AC amplifier circuit 26*b* amplifies the inputted voltage value 11 times.

The DC voltage generating unit 22 comprises first and second DC voltage generating circuits 27*a* and 27*b* which are identical with each other and each of which generates a DC voltage of −6V.

The amplifier circuit unit 23 comprises first and second amplifier circuits 28*a* and 28*b* which are identical with each other and each of which amplifies the inputted voltage value 100 times. The first amplifier circuit 28*a* is connected to the charging rollers 3*a*, 3*b*, and 3*c*; the second amplifier circuit 28*b* is connected to the charging roller 3*d*.

Next, the voltage application control for each of the charging rollers 3*a*, 3*b*, 3*c*, and 3*d* from the high-voltage power supply 20 during the full-colored image forming and the mono-colored (black) image forming in the embodiment will be described.

A high-voltage to be applied to the charging roller 3*d* for charging the photosensitive drum 2*d* of the image forming section 1BK for black toner during the full-colored image forming is identical with the high-voltage applied during the mono-colored image forming, which is the voltage in which a DC voltage of −600V is superposed on an AC voltage having a frequency of 2000 Hz and a Vpp of 1800V. The high-voltage is generated by combining the second AC voltage generating circuit 24*b*, the third AC amplifier circuit 26*c*, the second DC voltage generating circuit 27*b*, and the second amplifier circuit 28*b*.

A high-voltage to be applied to the charging roller 3*d* for charging the photosensitive drum 2*d* of the image forming section 1BK for black toner is changeable for adjusting the density of a toner image to be formed on a recording member or for corresponding to ambient circumstances (temperature, humidity) in the image forming apparatus. Therefore, as long as the above-mentioned environmental conditions are substantially the same or within a predetermined range, the high-voltage to be applied to the charging roller 3*d* for black toner during the full-colored image forming is to be identical with the high-voltage applied during the mono-colored image forming.

On the other hand, to the charging rollers 3*a*, 3*b*, and 3*c* for charging the respective photosensitive drums 2*a*, 2*b*, and 2*c* in the image forming sections 1M, 1C, and 1Y for color toner, a high-voltage having a voltage value during the full-colored image forming different from the high-voltage applied during the mono-colored (black) image forming is applied by switching the change-over switch 25.

That is, during the full-colored image forming, by switching the change-over switch 25 to the position connecting to the first AC amplifier circuit 26*a*, the voltage in which a DC voltage of −600V is superposed on an AC voltage having a frequency of 2000 Hz and a Vpp of 1800V is applied to each of the charging rollers 3*a*, 3*b*, and 3*c*. The high-voltage is generated by combining the first AC voltage generating circuit 24*a*, the first AC amplifier circuit 26*a*, the first DC voltage generating circuits 27*a*, and the first amplifier circuit 28*a*.

On the other hand, during the mono-colored (black) image forming, by switching the change-over switch 25 to the position connecting to the second AC amplifier circuit 26*b*, the voltage in which a DC voltage of −600V is superposed on an AC voltage having a frequency of 2000 Hz and a Vpp of 1100V is applied to each of the charging rollers 3*a*, 3*b*, and 3*c*. The high-voltage is generated by combining the first AC voltage generating circuit 24*a*, the second AC amplifier circuit 26*b*, the first DC voltage generating circuit 27*a*, and the first amplifier circuit 28*a*.

In such a manner, during the mono-colored image forming, the value of a high-voltage to be applied to the respective charging rollers 3*a*, 3*b*, and 3*c* for charging the photosensitive drums 2*a*, 2*b*, and 2*c* of the image forming sections 1M, 1C, and 1Y for color toner is reduced to be smaller than the value (Vpp) of the high-voltage to be applied to the respective charging rollers 3*a*, 3*b*, and 3*c* during the full-colored image forming (reduced to 1100V from 1800V). In addition, this is a comparison when the ambient circumstances (temperature, humidity) in the image forming apparatus during the mono-colored image forming are substantially the same as those during the full-colored image forming or when both the circumstances fall within a predetermined range.

This is because that during the mono-colored image forming, the image forming sections 1M, 1C, and 1Y for color toner do not form images, so that the surfaces of the photosensitive drums 2*a*, 2*b*, and 2*c* may be charged to such an extent that toner is not developed (not fogged), and that the charging uniformity is not so much required. Accordingly, the AC voltage ingredient Vpp of the voltage to be applied to the respective charging rollers 3*a*, 3*b*, and 3*c* for charging the photosensitive drums 2*a*, 2*b*, and 2*c* is set in the minimum limit of 1100V required for converging the surface potential of the photosensitive drums 2*a*, 2*b*, and 2*c*.

In the embodiment, during the mono-colored (black) image forming, the electric discharge between the charging rollers 3*a*, 3*b*, and 3*c* and the photosensitive drums 2*a*, 2*b*, and 2*c* of the image forming sections 1M, 1C, and 1Y for color toner is reduced by such voltage control, so that a shaving-off phenomenon on the surfaces of the photosensitive drums 2*a*, 2*b*, and 2*c* can be decreased, and thereby increasing the lifespan of the photosensitive drums 2*a*, 2*b*, and 2*c*.

Second Embodiment

Figure 2:
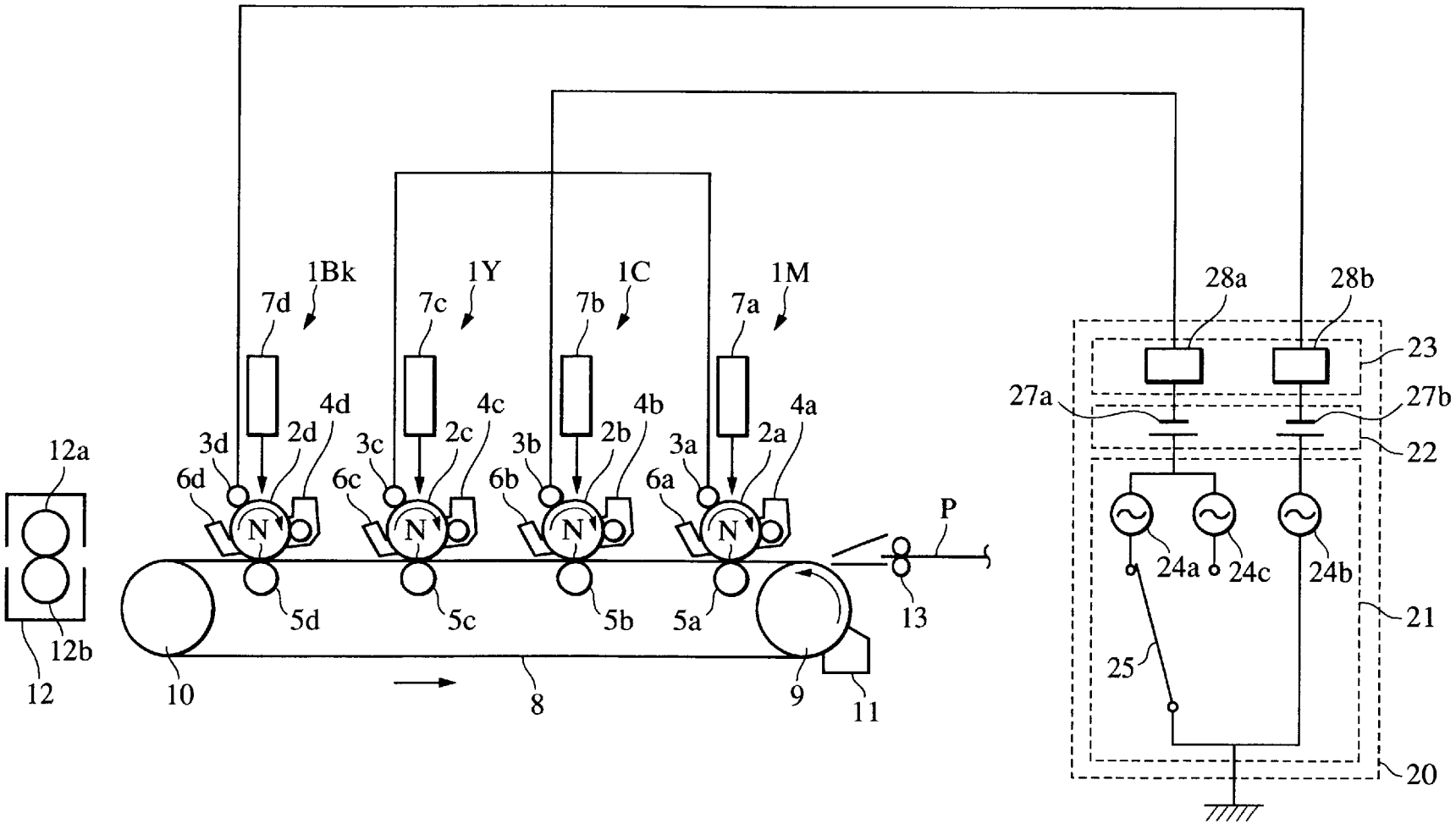
FIG. 2 is a schematic block diagram of an image forming apparatus according to a second embodiment of the present invention.

FIG. 2 is a schematic block diagram of an image forming apparatus according to a second embodiment of the present invention. In addition, like reference characters designate like portions having functions common to those of the first embodiment described above, and superfluous description thereof is omitted. In the embodiment, the image forming is performed just like in the image forming apparatus according to the first embodiment, so that description of image forming operation according to the embodiment is omitted. In the embodiment, during the mono-colored (black) image forming, the value of a frequency of the AC voltage to be applied from the high-voltage power supply 20 to the charging rollers 3*a*, 3*b*, and 3*c* which are for color toner and do not form images is set smaller than the value applied during the full-colored image forming. Other structures are the same as those in the first embodiment.

Next, the structure of the high-voltage power supply 20 in the embodiment will be described.

The high-voltage power supply 20 is a circuit for generating a voltage to be applied to each of the charging rollers 3*a*, 3*b*, 3*c*, and 3*d*, and comprises the AC voltage generating unit 21, the DC voltage generating unit 22, and the amplifier circuit unit 23.

The AC voltage generating unit 21 comprises first, second, and third AC voltage generating circuits 24*a*, 24*b*, and 24*c* which are identical with each other. The first AC voltage generating circuit 24*a* and the third AC voltage generating circuit 24*c* are switchable via the change-over switch 25. The first and second AC voltage generating circuits 24*a* and 24*b* generate sine wave AC voltages each having a frequency of 2000 Hz and a Vpp of 18V; the third AC voltage generating circuit 24*c* generates a sine wave AC voltage having a frequency of 1000 Hz and a Vpp of 11V.

The DC voltage generating unit 22 comprises the first and second DC voltage generating circuits 27*a* and 27*b* which are identical with each other and each of which generates a DC voltage of −6V.

The amplifier circuit unit 23 comprises the first and second amplifier circuits 28*a* and 28*b* which are identical with each other and each of which amplifies the inputted voltage value 100 times. The first amplifier circuit 28*a* is connected to the charging rollers 3*a*, 3*b*, and 3*c*; the second amplifier circuit 28*b* is connected to the charging roller 3*d*.

Next, the voltage application control for each of the charging rollers 3*a*, 3*b*, 3*c*, and 3*d* from the high-voltage power supply 20 during the full-colored image forming and the mono-colored (black) image forming in the embodiment will be described.

The high-voltage to be applied to the charging roller 3*d* for charging the photosensitive drum 2*d* of the image forming section 1BK for black toner during the full-colored image forming is identical with the high-voltage applied during the mono-colored image forming, which is the voltage in which a DC voltage of −600V is superposed on an AC voltage having a frequency of 2000 Hz and a Vpp of 1800V. The high-voltage is generated by combining the second AC voltage generating circuit 24*b*, the second DC voltage generating circuit 27*b*, and the second amplifier circuit 28*b*.

On the other hand, to the charging rollers 3*a*, 3*b*, and 3*c* for charging the respective photosensitive drums 2*a*, 2*b*, and 2*c* in the image forming sections 1M, 1C, and 1Y for color toner, during the full-colored image forming, the high-voltage having a different voltage value is applied from the voltage value applied during the mono-colored (black) image forming by switching the change-over switch 25.

That is, during the full-colored image forming, by switching the change-over switch 25 to the position connecting to the first AC voltage generating circuit 24*a*, the voltage in which a DC voltage of −600V is superposed on an AC voltage having a frequency of 2000 Hz and a Vpp of 1800V is applied to each of the charging rollers 3*a*, 3*b*, and 3*c*. The high-voltage is generated by combining the first AC voltage generating circuit 24*a*, the first DC voltage generating circuits 27*a*, and the first amplifier circuit 28*a*.

On the other hand, during the mono-colored (black) image forming, by switching the change-over switch 25 to the position connecting to the third AC voltage generating circuit 24*c*, the voltage in which a DC voltage of −600V is superposed on an AC voltage having a frequency of 1000 Hz and a Vpp of 1100V is applied to each of the charging rollers 3*a*, 3*b*, and 3*c*. The high-voltage is generated by combining the third AC voltage generating circuit 24*c*, the first DC voltage generating circuit 27*a*, and the first amplifier circuit 28*a*.

In such a manner, during the mono-colored image forming, the frequency of a high-voltage to be applied to the respective charging rollers 3*a*, 3*b*, and 3*c* for charging the photosensitive drums 2*a*, 2*b*, and 2*c* of the image forming sections 1M, 1C, and 1Y for color toner is to be smaller than the frequency applied during the full-colored image forming (decreased from 2000 Hz to 1000 Hz).

This is because that during the mono-colored image forming, the image forming sections 1M, 1C, and 1Y for color toner do not form images, so that the surfaces of the photosensitive drums 2*a*, 2*b*, and 2*c* may be charged to such an extent that toner is not developed, and the charging uniformity is not so much required. Accordingly, the AC voltage ingredient frequency of the voltage to be applied to the respective charging rollers 3*a*, 3*b*, and 3*c* for charging the photosensitive drums 2*a*, 2*b*, and 2*c* is set to be 1000 Hz.

Also, in order to have much better benefits, just like in the first embodiment, the peak-to-peak voltage of the high-voltage to be applied to the charging rollers 3*a*, 3*b*, and 3*c* during the mono-colored image forming may be reduced to be smaller than the peak-to-peak voltage applied during the full-colored image forming.

In the embodiment, during the mono-colored (black) image forming, the electric discharge between the charging rollers 3*a*, 3*b*, and 3*c* and the photosensitive drums 2*a*, 2*b*, and 2*c* of the image forming sections 1M, 1C, and 1Y for color toner is reduced by such voltage control, so that a shaving-off phenomenon on the surfaces of the photosensitive drums 2*a*, 2*b*, and 2*c* can be decreased, and thereby increasing the lifespan of the photosensitive drums 2*a*, 2*b*, and 2*c*.

Third Embodiment

Figure 3:
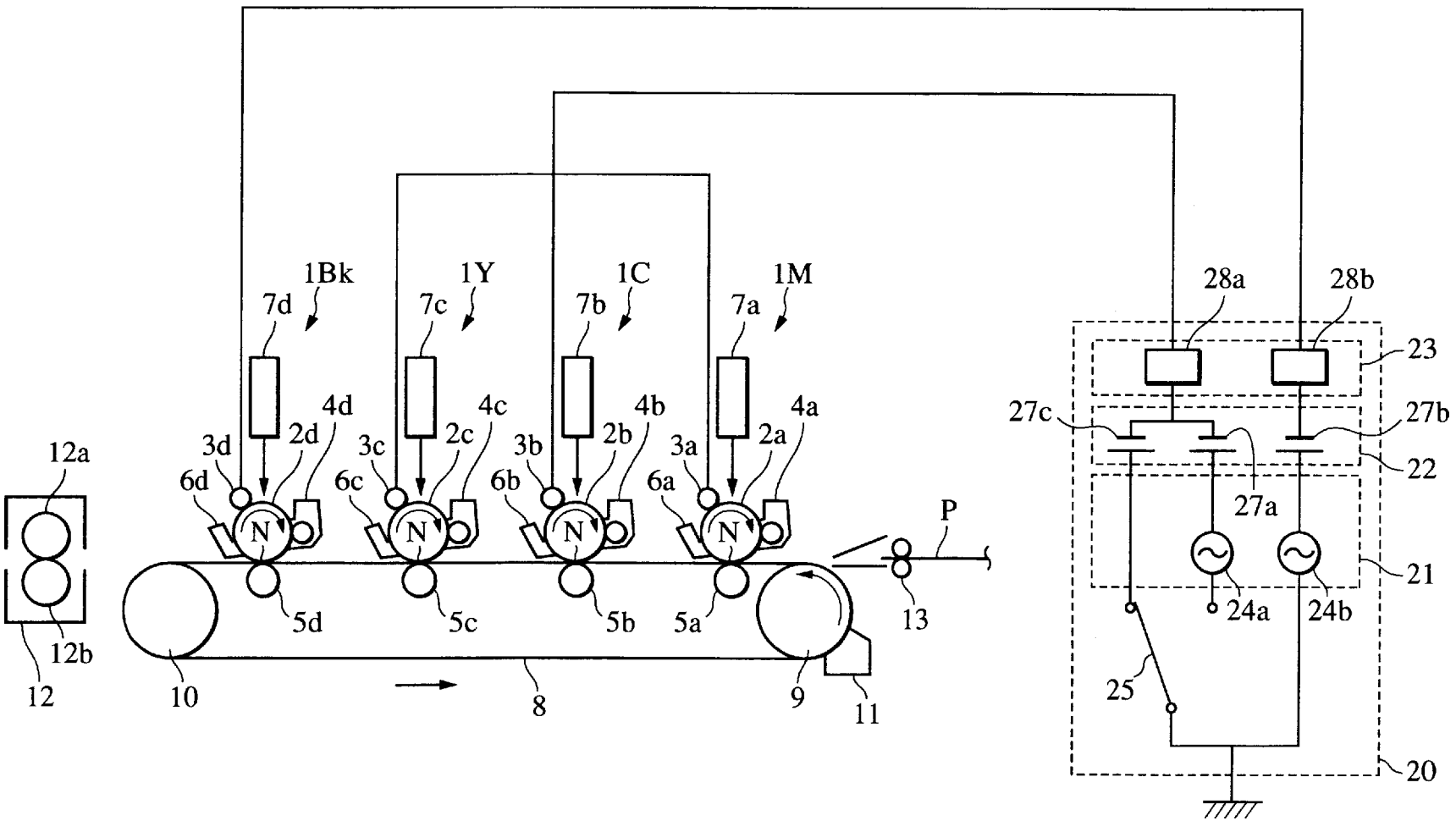
FIG. 3 is a schematic block diagram of an image forming apparatus according to a third embodiment of the present invention.

FIG. 3 is a schematic block diagram of an image forming apparatus according to a third embodiment of the present invention. In addition, like reference characters designate like portions having functions common to those of the first embodiment described above, and superfluous description thereof is omitted. In the embodiment, the image forming is performed just like in the image forming apparatus according to the first embodiment, so that description of image forming operation according to the embodiment is omitted. In the embodiment, during the mono-colored (black) image forming, only the DC voltage in the voltage to be applied from the high-voltage power supply 20 is applied to the charging rollers 3*a*, 3*b*, and 3*c* which are for color toner and do not form images. Other structures are the same as those in the first embodiment.

Next, the structure of the high-voltage power supply 20 in the embodiment will be described.

The high-voltage power supply 20 is a circuit for generating a voltage to be applied to each of the charging rollers 3*a*, 3*b*, 3*c*, and 3*d*, and comprises the AC voltage generating unit 21, the DC voltage generating unit 22, and the amplifier circuit unit 23.

The AC voltage generating unit 21 comprises first and second AC voltage generating circuits 24*a* and 24*b* which are identical with each other and the change-over switch 25. The first and second AC voltage generating circuits 24*a* and 24*b* generate sine wave AC voltages each having a frequency of 2000 Hz and a Vpp of 18V.

The DC voltage generating unit 22 comprises the first and second DC voltage generating circuits 27*a* and 27*b* which are identical with each other and a third DC voltage generating circuit 27*c*. Each of the first and second DC voltage generating circuits 27*a* and 27*b* generates a DC voltage of −6V; the third DC voltage generating circuit 27*c* generates a DC voltage of −11.5V.

The amplifier circuit unit 23 comprises the first and second amplifier circuits 28*a* and 28*b* which are identical with each other and each of which amplifies the inputted voltage value 100 times. The first amplifier circuit 28*a* is connected to the charging rollers 3*a*, 3*b*, and 3c; the second amplifier circuit 28*b* is connected to the charging roller 3*d*.

Next, the voltage application control for each of the charging rollers 3*a*, 3*b*, 3*c*, and 3*d* from the high-voltage power supply 20 during the full-colored image forming and the mono-colored (black) image forming in the embodiment will be described.

The high-voltage to be applied to the charging roller 3*d* for charging the photosensitive drum 2*d* of the image forming section 1BK for black toner during the full-colored image forming is identical with the high-voltage applied during the mono-colored image forming, which is the voltage in which a DC voltage of −600V is superposed on an AC voltage having a frequency of 2000 Hz and a Vpp of 1800V. The high-voltage is generated by combining the second AC voltage generating circuit 24*b*, the second DC voltage generating circuit 27*b*, and the second amplifier circuit 28*b*.

On the other hand, to the charging rollers 3*a*, 3*b*, and 3*c* for charging the respective photosensitive drums 2*a*, 2*b*, and 2*c* in the image forming sections 1M, 1C, and 1Y for color toner, during the full-colored image forming, the high-voltage having a different voltage value is applied from the voltage applied during the mono-colored (black) image forming by switching the change-over switch 25.

That is, during the full-colored image forming, by switching the change-over switch 25 to the position connecting to the first AC voltage generating circuit 24*a*, the voltage in which a DC voltage of 600V is superposed on an AC voltage having a frequency of 2000 Hz and a Vpp of 1800V is applied to each of the charging rollers 3*a*, 3*b*, and 3*c*. The high-voltage is generated by combining the first AC voltage generating circuit 24*a*, the first DC voltage generating circuits 27*a*, and the first amplifier circuit 28*a*.

On the other hand, during the mono-colored (black) image forming, by switching the change-over switch 25 to the position connecting to the third DC voltage generating circuit 27*c*, a DC voltage of −1150V is applied to each of the charging rollers 3*a*, 3*b*, and 3*c*. The high-voltage is generated by combining the third DC voltage generating circuit 27*c* and the first amplifier circuit 28*a*.

In such a manner, during the mono-colored image forming, each of the photosensitive drums 2*a*, 2*b*, and 2*c* is charged by applying only the DC voltage to the respective charging rollers 3*a*, 3*b*, and 3*c*, so that the charging potential of each of the photosensitive drums 2*a*, 2*b*, and 2*c* is the value obtained by subtracting the starting voltage (−550V) from the applied voltage (−1150V). Accordingly, the charging potential of each of the photosensitive drums 2*a*, 2*b*, and 2*c* at this time is approximately −600V. Although the charging uniformity by the charging method using the DC voltage is inferior than that by the charging method using the AC voltage, it is known that the electric discharge during the charging by the charging method using the DC voltage is extremely reduced.

Also, during the mono-colored image forming, the image forming sections 1M, 1C, and 1Y for color toner do not form images, so that the surfaces of the photosensitive drums 2*a*, 2*b*, and 2*c* may be charged to such an extent that toner is not developed, and the charging uniformity is not so much required. Accordingly, only the DC voltage is to be applied to the charging rollers 3*a*, 3*b*, and 3*c* for charging the photosensitive drums 2*a*, 2*b*, and 2*c*.

In the embodiment, during the mono-colored image forming, the electric discharge between the charging rollers 3*a*, 3*b*, and 3*c* and the photosensitive drums 2*a*, 2*b*, and 2*c* of the image forming sections 1M, 1C, and 1Y for color toner is reduced by such voltage control, so that shaving-off on the surfaces of the photosensitive drums 2*a*, 2*b*, and 2*c* can be decreased, and thereby increasing a lifespan of the photosensitive drums 2*a*, 2*b*, and 2*c*.

Fourth Embodiment

Figure 4:
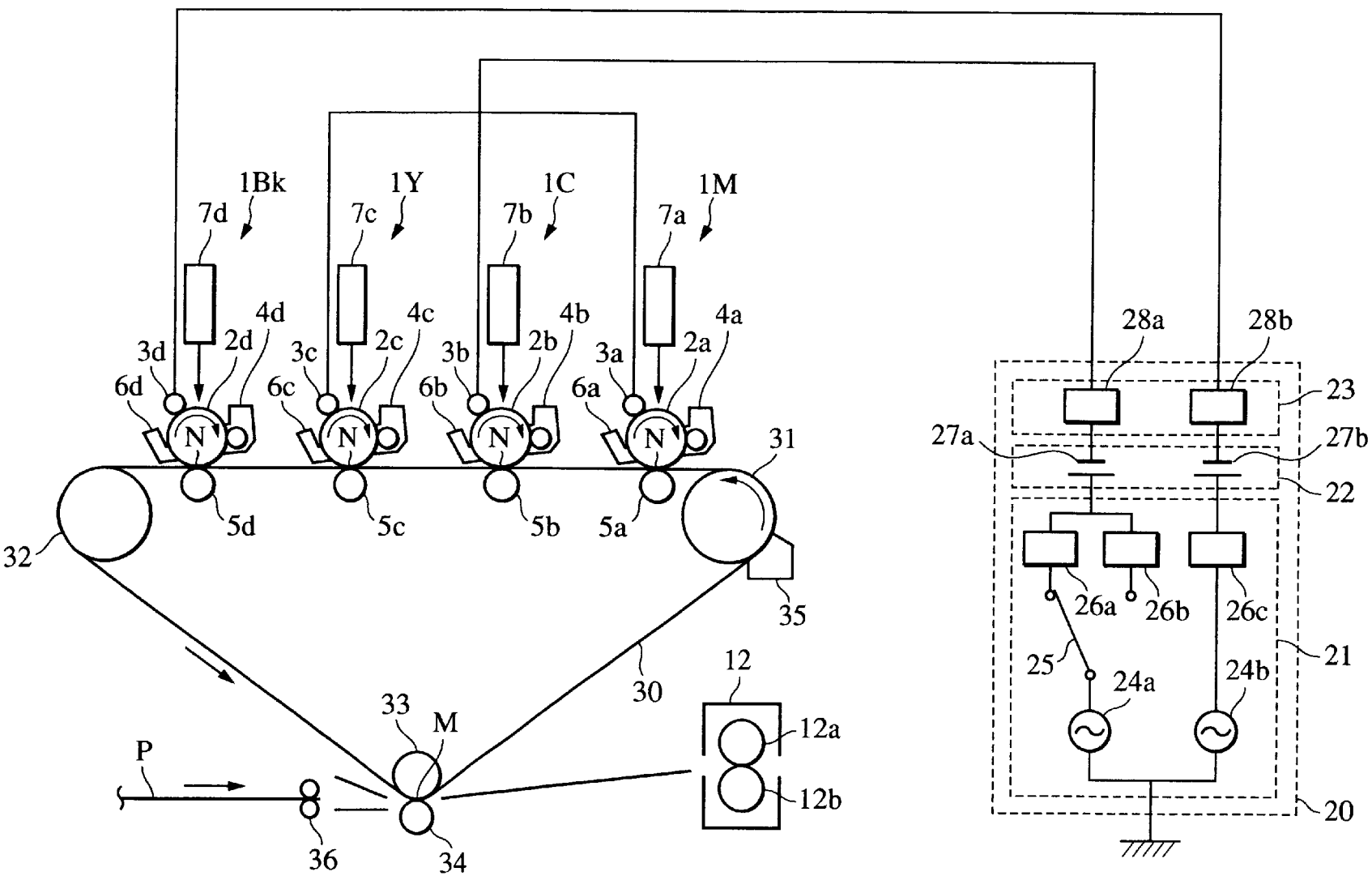
FIG. 4 is a schematic block diagram of an image forming apparatus according to a fourth embodiment of the present invention.

FIG. 4 is a schematic block diagram of an image forming apparatus according to a fourth embodiment of the present invention. In addition, like reference characters designate like portions having functions common to those of the first embodiment described above, and superfluous description thereof is omitted. In this embodiment, a first aspect of the present invention described in the first embodiment is applied to an image forming apparatus in which a toner image of each color formed on each of four photosensitive drums is sequentially overlaid on an intermediate transfer belt as an intermediate transfer carrier so as to be transferred on a recording member together at a secondary transfer nip.

In the image forming apparatus, at each of primary transfer nips N of the respective photosensitive drums 2*a*, 2*b*, 2*c*, and 2*d* in the image forming sections 1M, 1C, 1Y, and 1BK, an endless belt type intermediate transfer carrier 30 is abutted as a transfer medium instead of the conveyor belt for a recording member described above. The intermediate transfer belt 30 is stretched between a driving roller 31, a supporting roller 32, and a secondary transfer opposing roller 33, and is rotated (moved) in an arrow direction (counterclockwise) by the driving roller 31.

Primary transfer rollers 5*a*, 5*b*, 5*c*, and 5*d* abut the respective photosensitive drums 2*a*, 2*b*, 2*c*, and 2*d* at each transfer nip N via the intermediate transfer belt 30. The secondary transfer opposing roller 33 abuts a secondary transfer roller 34 via the intermediate transfer belt 30 to form a secondary transfer nip M. The secondary transfer roller 34 is arranged so as to be separable from and touchable to the intermediate transfer belt 30. In the vicinity of the driving roller 31 outside the intermediate transfer belt 30, a belt cleaning device 35 is arranged for removing and recovering transfer toner remnants remaining on the surface of the intermediate transfer belt 30. In the downstream side of the secondary transfer nip M in the direction conveying a recording member, the fuser 12 having the fixing roller 12*a* and the pressurizing roller 12*b* is placed.

Next, image forming operation in the image forming apparatus according to the embodiment will be described.

When a signal for starting image forming operation is outputted, each of the photosensitive drums 2*a*, 2*b*, 2*c*, and 2*d* rotating at a predetermined process speed of the image forming sections 1M, 1C, 1Y, and 1BK is uniformly charged by the respective charging rollers 3*a*, 3*b*, 3*c*, and 3*d* to have negative polarity in the embodiment. In the laser output unit (not shown), the exposure devices 7*a*, 7*b*, 7*c*, and 7*d* convert the respective inputted color-separated image signals into optical signals. Each of the charged photosensitive drums 2*a*, 2*b*, 2*c*, and 2*d* is scanned and exposed with a laser beam which is the converted optical signal so as to form an electrostatic latent image.

Then first, magenta toner is stuck on the electrostatic latent image formed on the photosensitive drum 2*a* by the developing device 4*a* having a developing bias applied thereto with the same polarity as the charge polarity (negative polarity) of the photosensitive drum 2*a* so as to form a visible image as a toner image. This magenta toner image is primarily transferred on the rotating intermediate transfer belt 30 at the primary transfer nip N by the transfer roller 5*a* having a primary transfer bias applied thereto with reverse polarity to toner (positive polarity). The intermediate transfer belt 30 having the magenta toner image transferred thereon is rotated toward the image forming section 1C. In the image forming section 1C, a cyan toner image formed on the photosensitive drum 2*b* is also transferred at the primary transfer nip N just as described above so as to be overlaid on the magenta toner image on the intermediate transfer belt 30.

Similiarly, on the magenta and cyan toner images transferred and overlaid on the intermediate transfer belt 30, yellow and black toner images formed on the photosensitive drums 2*c* and 2*d* of the image forming sections 1Y and 1BK are sequentially overlaid at each transfer nip N so as to form a full-colored toner image on the intermediate transfer belt 30.

Then, a recording member P is conveyed to the secondary transfer nip M by resist rollers 36 in accordance with the timing that the tip of the full-colored toner image on the intermediate transfer belt 30 is moved to the secondary transfer nip M. On this recording member P, the full-colored toner image is secondarily transferred together by the secondary transfer roller 34 having a secondary transfer bias applied thereto with reverse polarity to toner (positive polarity). The recording member P having the full-colored image formed thereon is conveyed to the fuser 12, so that the full-colored toner image is heated and pressurized in the fixing nip between the fixing roller 12*a* and the pressurizing roller 12*b* of the fuser 12 so as to be thermally fixed on the surface of the recording member P, and then, discharged outside so as to finish a series of image forming operations.

During the primary transferring described above, primary transfer toner remnants remaining on the photosensitive drums 2*a*, 2*b*, 2*c*, and 2*d* are removed by the drum cleaning devices 6*a*, 6*b*, 6*c*, and 6*d* so as to be recovered, respectively. The secondary transfer toner remnants remaining on the intermediate transfer belt 30 after the secondary transferring is removed by the belt-cleaning device 35 so as to be recovered.

Also, just like the image forming apparatus described in the first embodiment, a mono-colored image (black mono-color) forming mode other than the full-colored mode described above can be selected. When the mono-colored mode is selected, only the image forming section for forming a black image is performed in a similar manner to the full-colored mode, and a rotating mechanism for the photosensitive drums and a charging mechanism by the charging rollers in the other image forming sections are only activated.

That is, even when the mono-colored mode is selected, in the image forming sections which do not form images, the photosensitive drums are rotated; their contact with the conveyor belt for a recording member is maintained as well; furthermore, the rotation of the developing sleeves, the application of developing biases, and the rotation of the charging rollers and the application of charging biases for preventing a toner fog from the developing devices are performed. In the image forming sections which do not form images, the photosensitive drums are not exposed with light (or blank sheets are exposed with light) and the drum cleaning devices (cleaning blades) for cleaning photosensitive drums maintain the abutment to the photosensitive drums.

Also, in the embodiment, to each of the charging rollers 3*a*, 3*b*, 3*c*, and 3*d*, the high-voltage power supply 20 is connected. The structure of the high-voltage power supply 20 in the embodiment is the same as that in the first embodiment, so that the description thereof is omitted. Also, in the embodiment, from the high-voltage power supply 20, the voltage control described in the first embodiment is performed to each of the charging rollers 3*a*, 3*b*, and 3*c* during the full-colored image forming and during the mono-colored (black) image forming. That is, during the mono-colored image forming, the value of a high-voltage to be applied to the respective charging rollers 3*a*, 3*b*, and 3*c* for charging the photosensitive drums 2*a*, 2*b*, and 2*c* of the image forming sections 1M, 1C, and 1Y for color toner is reduced to be smaller than the value of a high-voltage to be applied during the full-colored image forming (reduced to 1100V from 1800V).

During the mono-color printing, the electric discharge between the charging rollers 3*a*, 3*b*, and 3*c* and the photosensitive drums 2*a*, 2*b*, and 2*c* of the image forming sections 1M, 1C, and 1Y for color toner is reduced by such voltage control, so that shaving-off on the surfaces of the photosensitive drums 2*a*, 2*b*, and 2*c* can be decreased, and thereby increasing a lifespan of the photosensitive drums 2*a*, 2*b*, and 2*c*.

Fifth Embodiment

Figure 5:
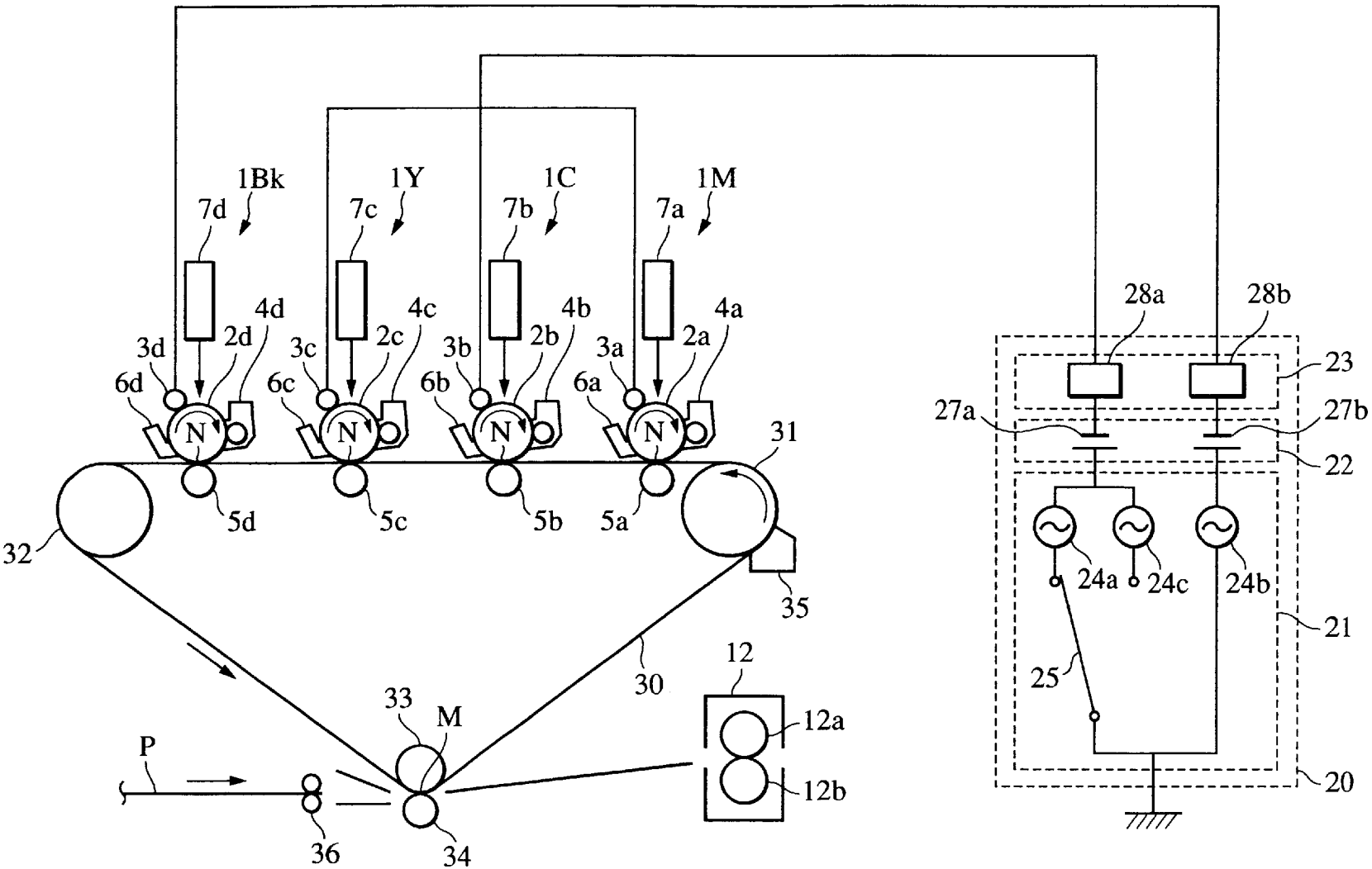
FIG. 5 is a schematic block diagram of an image forming apparatus according to a fifth embodiment of the present invention.

FIG. 5 is a schematic block diagram of an image forming apparatus according to a fifth embodiment of the present invention. In addition, like reference characters designate like portions having functions common to those of the fourth embodiment described above, and superfluous description thereof is omitted. In this embodiment, a second aspect of the present invention described in the second embodiment is applied to an image forming apparatus in which a toner image of each color formed on each of four photosensitive drums is sequentially overlaid on an intermediate transfer belt as an intermediate transfer carrier so as to be transferred on a recording member together at a secondary transfer nip.

Also, in the embodiment, to each of the charging rollers 3*a*, 3*b*, 3*c*, and 3*d*, the high-voltage power supply 20 is connected. The structure of the high-voltage power supply 20 in the embodiment is the same as that in the second embodiment, so that the description thereof is omitted. Also, in the embodiment, from the high-voltage power supply 20, the voltage control described in the second embodiment is performed to each of the charging rollers 3*a*, 3*b*, and 3*c* during the full-colored image forming and during the mono-colored (black) image forming. That is, during the mono-colored image forming, the frequency of a high-voltage to be applied to the respective charging rollers 3*a*, 3*b*, and 3*c* for charging the photosensitive drums 2*a*, 2*b*, and 2*c* of the image forming sections 1M, 1C, and 1Y for color toner is reduced to be smaller than the frequency during the full-colored image forming (reduced to 1000 Hz from 2000 Hz).

Also, in order to have much better benefits, just like in the fourth embodiment, the peak-to-peak voltage of the high-voltage to be applied to the charging rollers 3*a*, 3*b*, and 3*c* during the mono-colored image forming may be reduced to be smaller than that during the full-colored image forming.

During the mono-color image forming, the electric discharge between the charging rollers 3*a*, 3*b*, and 3*c* and the photosensitive drums 2*a*, 2*b*, and 2*c* of the image forming sections 1M, 1C, and 1Y for color toner is reduced by such voltage control, so that shaving-off on the surfaces of the photosensitive drums 2*a*, 2*b*, and 2*c* can be decreased, and thereby increasing a lifespan of the photosensitive drums 2*a*, 2*b*, and 2*c*.

Sixth Embodiment

Figure 6:
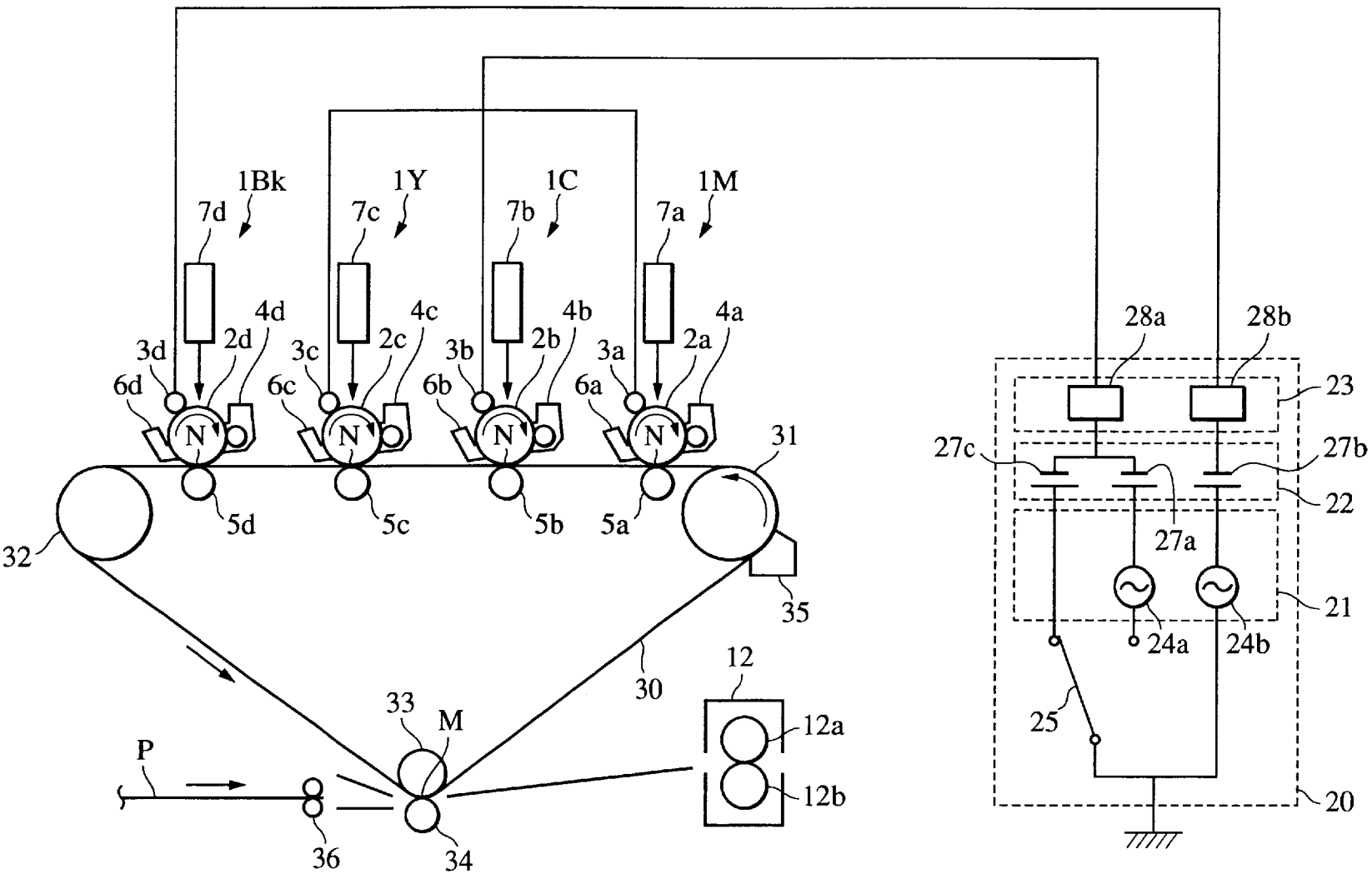
FIG. 6 is a schematic block diagram of an image forming apparatus according to a sixth embodiment of the present invention.
Figure 7:
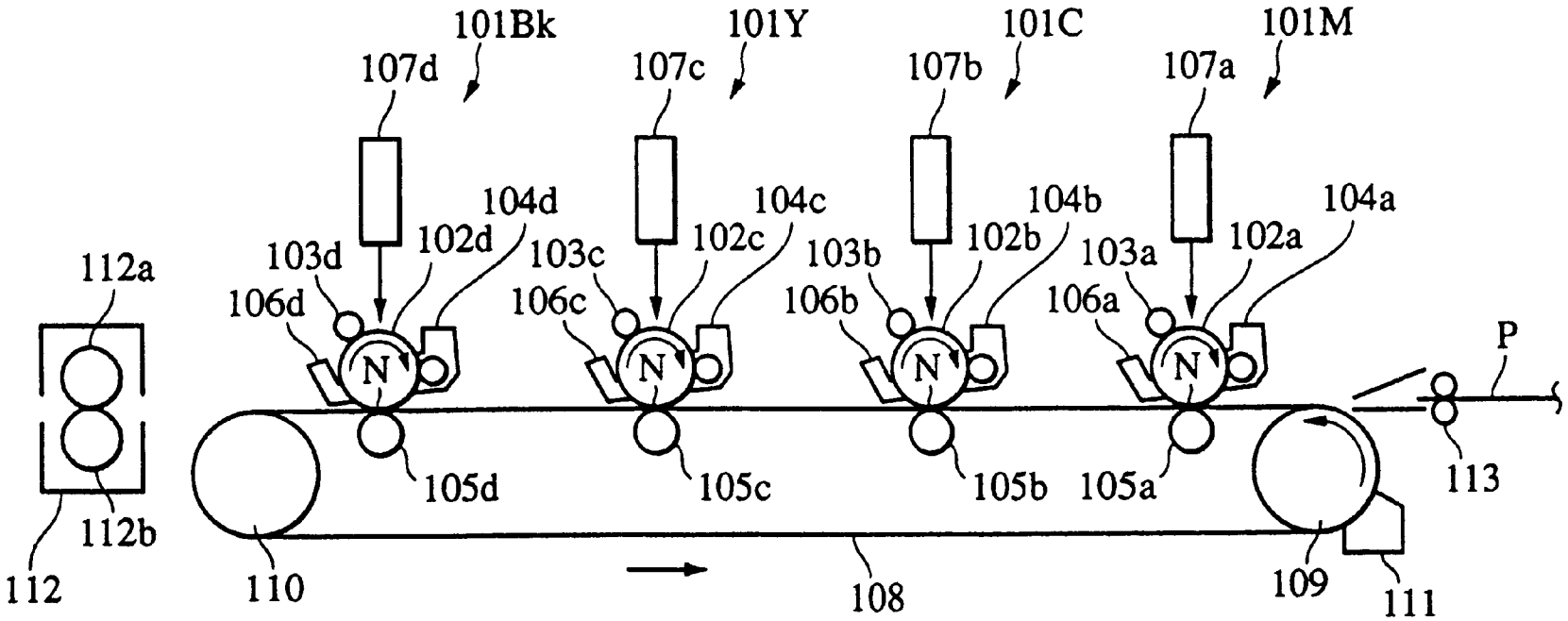
FIG. 7 PRIOR ART
FIG. 7 is a schematic block diagram of a conventional image forming apparatus.

FIG. 6 is a schematic block diagram of an image forming apparatus according to a sixth embodiment of the present invention. In addition, like reference characters designate like portions having functions common to those of the fourth and fifth embodiments described above, and superfluous description thereof is omitted. In this embodiment, a third aspect of the present invention described in the third embodiment is applied to an image forming apparatus in which a toner image of each color formed on each of four photosensitive drums is sequentially overlaid on an intermediate transfer belt as an intermediate transfer carrier so as to be transferred on a recording member together at a secondary transfer nip.

Also, in the embodiment, to each of the charging rollers 3*a*, 3*b*, 3*c*, and 3*d*, the high-voltage power supply 20 is connected. The structure of the high-voltage power supply 20 in the embodiment is the same as that in the third embodiment, so that the description thereof is omitted. Also, in the embodiment, from the high-voltage power supply 20, the voltage control described in the third embodiment is performed to each of the charging rollers 3*a*, 3*b*, and 3*c* during the full-colored image forming and during the mono-colored (black) image forming. That is, during the mono-colored image forming, each of the photosensitive drums 2*a*, 2*b*, and 2*c* is charged by applying only the DC voltage to the respective charging rollers 3*a*, 3*b*, and 3*c*, so that the charging potential of each of the photosensitive drums 2*a*, 2*b*, and 2*c* is the value obtained by subtracting the starting voltage (−550V) from the applied voltage (−1150V).

During the mono-color image forming, the electric discharge between the charging rollers 3*a*, 3*b*, and 3*c* and the photosensitive drums 2*a*, 2*b*, and 2*c* of the image forming sections 1M, 1C, and 1Y for color toner is reduced by such voltage control, so that shaving-off on the surfaces of the photosensitive drums 2*a*, 2*b*, and 2*c* can be decreased, and thereby increasing a lifespan of the photosensitive drums 2*a*, 2*b*, and 2*c*.

In each of the embodiments described above, when the image forming apparatus is provided with a process cartridge in which the photosensitive drums 2*a*, 2*b*, 2*c*, and 2*d* of the image forming sections 1M, 1C, 1Y, and 1Bk, the charging rollers 3*a*, 3*b*, 3*c*, and 3*d*, and the developing devices 4*a*, 4*b*, 4*c*, and 4*d* are respectively integrated, shaving-off on the photosensitive drums 2*a*, 2*b*, and 2*c* using color toner can be decreased so as to increase the lifespan thereof, so that toner contained therein may be efficiently used all.

Also, the control for reducing the shaving-off on the surfaces of the photosensitive drums 2*a*, 2*b*, and 2*c* during the mono-colored (black) image forming has been described in each of the embodiments described above; however, the present invention is not limited to this, so that the same benefits may also be obtained even when the present invention is applied to the mono-colored image forming for any one of colors of yellow, magenta, and cyan, or to the two- or three-colored image forming for two or three colors in the four colors. That is, when the two- or three-colored mode is selected, the present invention may be applied to the image forming sections which do not form images, and thereby increasing the lifespan of the photosensitive drums which do not form images.

The example using a contact-type roller charger (charging roller) as charging means is also described in each of the embodiments described above; it is an example in which the benefits of the present invention can be achieved most efficiently; even when chargers of other structures or non-contact type chargers, etc., are applied to the present invention, the shaving-off on the surfaces of the photosensitive drums due to an electric field effect may also be reduced.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a first image bearing member;

first charging means for charging the first image bearing member, a vibration voltage being applied to the first charging means;

a second image bearing member; and second charging means for charging the second image bearing member, a vibration voltage being applied to the second charging means, wherein said image forming apparatus is selectively operable in a first mode, in which toner images formed on the first image bearing member and the second image bearing member are transferred to a transfer medium, and in a second mode, in which a toner image formed on the second image bearing member is transferred to a transfer medium without forming a toner image on the first image bearing member, and wherein a voltage of the vibration voltage applied to the first charging means in the second mode is smaller than the voltage of the vibration voltage applied to the first changing means in the first mode.

2. An apparatus according to claim 1, wherein the peak-to-peak value of the vibration voltage applied to the first charging means in the second mode is smaller than the peak-to-peak value of the vibration voltage applied to the first charging means in the first mode.

3. An apparatus according to claim 2, wherein the peak-to-peak value of the vibration voltage applied to the first charging means in the second mode is zero.

4. An apparatus according to claim 2, wherein the frequency of the vibration voltage applied to the first charging means in the second mode is smaller than the frequency of the vibration voltage applied to the first changing means in the first mode.

5. An apparatus according to claim 1, wherein the first charging means charges the first image bearing member by making contact with the first image bearing member.

6. An apparatus according to claim 1, wherein in the second mode, a black image is transferred to the transfer medium from the second image bearing member.

7. An apparatus according to claim 1, wherein the image transferred to the transfer medium is further transferred to a recording member.

8. An apparatus according to claim 1, wherein in the first mode, the vibrating voltage applied to the first changing means and the second charging means includes a DC voltage.

9. An apparatus according to claim 1, wherein the vibrating voltage applied to the first charging means and the second charging means includes a DC voltage having the same polarity as the charge polarity of toner.

10. An apparatus according to any one of claims 1 to 9, wherein in the second mode, the vibrating voltage applied to the first charging means includes a DC voltage.

11. An apparatus according to claim 10, wherein in the second mode, the vibrating voltage applied to the second charging means includes a DC voltage.

12. An image forming apparatus comprising:

a first image bearing member;

first charging means for charging the first image bearing member, a vibration voltage being applied to the first charging means;

a second image bearing member; and second charging means for charging the second image bearing member, a vibration voltage being applied to the second charging means, wherein said image forming apparatus is selectively operable in a first mode, in which images formed on the first image bearing member and the second image bearing member are transferred to a transfer medium, and a second mode, in which an image formed on the second image bearing member is transferred to a transfer medium without forming an image on the first image bearing member, and wherein a frequency of the vibration voltage applied to the first charging means in the second mode is smaller than the frequency of the vibration voltage applied to the first changing means in the first mode.

13. An apparatus according to claim 12, wherein the frequency of the vibration voltage applied to the first charging means in the second mode is zero.

14. An apparatus according to claim 12, wherein the first charging means charges the first image bearing member by making contact with the first image bearing member.

15. An apparatus according to claim 12, wherein in the second mode, a black image is transferred to the transfer medium from the second image bearing member.

16. An apparatus according to claim 12, wherein an image transferred to the transfer medium is further transferred to a recording member.

17. An apparatus according to claim 12, wherein in the first mode, the vibrating voltage applied to the first and the second charging means includes a DC voltage.

18. An apparatus according to claim 12, wherein the vibrating voltage applied to the first and the second charging means includes a DC voltage having the same polarity as the charge polarity of toner.

19. An apparatus according to any one of claims 12 to 18, wherein in the second mode, the vibrating voltage applied to the first charging means includes a DC voltage.

20. An apparatus according to claim 19, wherein in the second mode, the vibrating voltage applied to the second charging means includes a DC voltage.

* * * * *

UNITED STATES PATENT AND TRADEMARK OFFICE

CERTIFICATE OF CORRECTION

PATENT NO. : 6,553,192 B2
DATED : April 22, 2003
INVENTOR(S) : Yoichiro Maebashi It is certified that error appears in the above-identified patent and that said Letters Patent is hereby corrected as shown below:

Title page,
Item [56], References Cited, FOREIGN PATENT DOCUMENTS,
"JP 362220977 * 9/1987" should read -- JP 62-220977 * 9/1987 --.
Item [57], ABSTRACT,
Line 9, "decrease," should read -- decreased, --.

Column 15,
Line 32, "used all." should read -- used. --.

Signed and Sealed this

Twenty-eighth Day of October, 2003

JAMES E. ROGAN
*Director of the United States Patent and Trademark Office*